US007297885B2

(12) United States Patent
Lee

(10) Patent No.: US 7,297,885 B2
(45) **Date of Patent: *Nov. 20, 2007**

(54) PRESSURE SWITCH

(76) Inventor: Paul Chia Lee, No. 18 Lane 557, Jhongjheng Rd., Wufong Township, Taichung County 413 (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/374,147

(22) Filed: Mar. 14, 2006

(65) Prior Publication Data

US 2007/0045091 A1 Mar. 1, 2007

Related U.S. Application Data

(63) Continuation-in-part of application No. 11/212,757, filed on Aug. 29, 2005, now Pat. No. 7,112,753.

(51) Int. Cl.
*H01H 35/40* (2006.01)

(52) U.S. Cl. ..... 200/83 R; 200/81 R

(58) Field of Classification Search ..... 200/83 J, 200/82 R, 82 C, 81 R, 81.9 R, 82 B, 82 A
See application file for complete search history.

(56) References Cited

U.S. PATENT DOCUMENTS

| | | | | |
|---|---|---|---|---|
| 5,872,345 | A * | 2/1999 | Takahashi et al. | 200/83 J |
| 5,889,247 | A * | 3/1999 | Homol | 200/83 P |
| 6,621,021 | B2 * | 9/2003 | Pechhold et al. | 200/83 A |
| D497,145 | S * | 10/2004 | Seo | D13/158 |
| 6,983,641 | B1 * | 1/2006 | Perry et al. | 73/37 |
| 7,038,151 | B2 * | 5/2006 | Amaduzzi | 200/82 R |

* cited by examiner

*Primary Examiner*—Michael A Friedhofer
*Assistant Examiner*—Lisa Klaus
(74) *Attorney, Agent, or Firm*—Rosenberg, Klein & Lee

(57) ABSTRACT

A water pressure switch employs two pivotable plates and springs to control the activation of the pump. The arrangement of the two pivotably plates, the springs and the activation device reduces the space required so that a small box can accommodate all the parts.

10 Claims, 9 Drawing Sheets

PRESSURE SWITCH

FIELD OF THE INVENTION

This is a Continuation-In-Part application of applicant's former patent application with application Ser. No. 11/212,757, filed on Aug. 29, 2005, now U.S. Pat. No. 7,112,753.

BACKGROUND OF THE INVENTION

A conventional pressure switch 9 is shown in FIG. 9 and generally includes a push member 91, a first plate 92, a second plate 93, a first contact point 94, a second contact point 95, a spring member 96 and a rectangular box 97 which receives all the parts therein. When the pressure of water is too low, the pump can be automatically activated to maintain a desired pressure in pipes.

When the pressure of water is high, the push member 91 pushes the first plate 92 which drives the second plate 93 and the first contact point 94 is moved by the second plate 93 to be separated from the second contact point 95 so as to stop the pump.

When the water pressure in pipes is lowered and smaller than the spring force of the spring member 96 in the pressure switch 9, the spring member 96 drives the two contact points 94, 95 to be in contact with each other to activate the pump.

However, when the direction of water flow form the inlet 98 and the swing direction of the first contact point 94 need a certain space to work so that the box 97 has to be large enough to receive all the parts therein. Besides, the inlet 98 is located off from the center of the box 97 so that it requires a larger space to install the box 97.

The present invention intends to provide a pressure switch wherein the direction of water flow form the inlet and the swing direction of the contact point are the same so that the box can be a cylindrical box and the inlet is located at the central axis of the box. This reduces the manufacturing cost.

SUMMARY OF THE INVENTION

The present invention relates to a pressure switch which comprises a box and an outer cover is connected to an open end of the box and an inlet is defined through the outer cover, an inner cover is engaged with the open end and has a central hole. A film is located between the outer cover and the inner cover, and has a push portion which extends through the inner cover. An initializing device has a rod and a first spring which is mounted to the rod and one end of the rod extends through a close end of the box. A first plate has a pivot end pivotably connected to the inner cover and a through hole is defined through the first plate. The first plate is located between the first spring and the push portion. A mounting hole is defined through the first plate so that the rod extends through the mounting hole. A second plate extends through the through hole of the first plate and has a pivotal end which is located opposite to the pivot end of the first plate and connected to the inner cover. An activation device is located above the first and second plates and includes a frame and a pull rod which is connected to a center of the frame. A second spring member is connected between a lug of the second plate and the pull rod. A first contact unit and a second contact unit are located on two sides of the pull rod and connected to the frame. When the pull rod is pulled by the second spring, the first and second contact units are in contact with each other.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
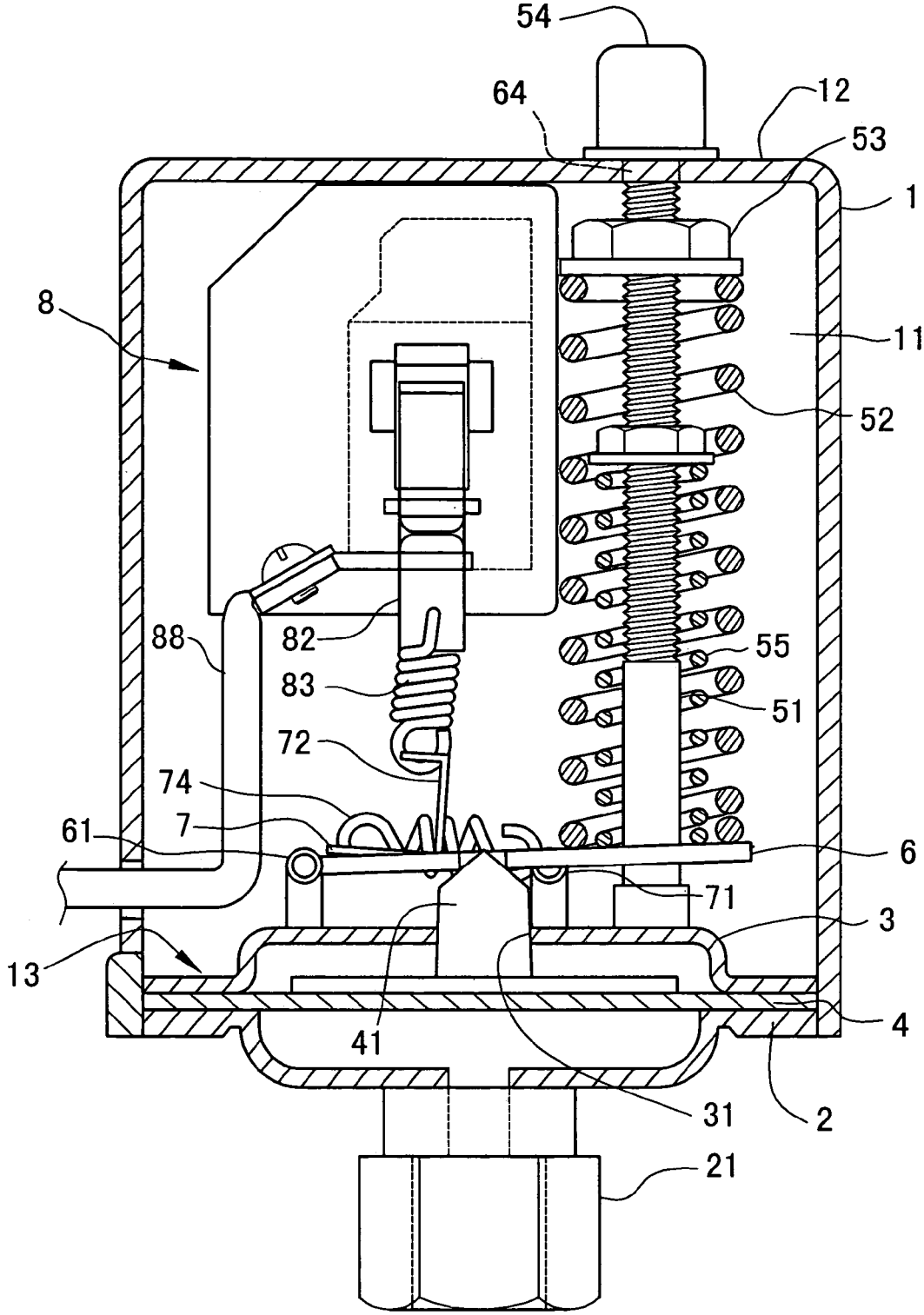
FIG. 1 shows the pressure switch of the present invention.
Figure 2:
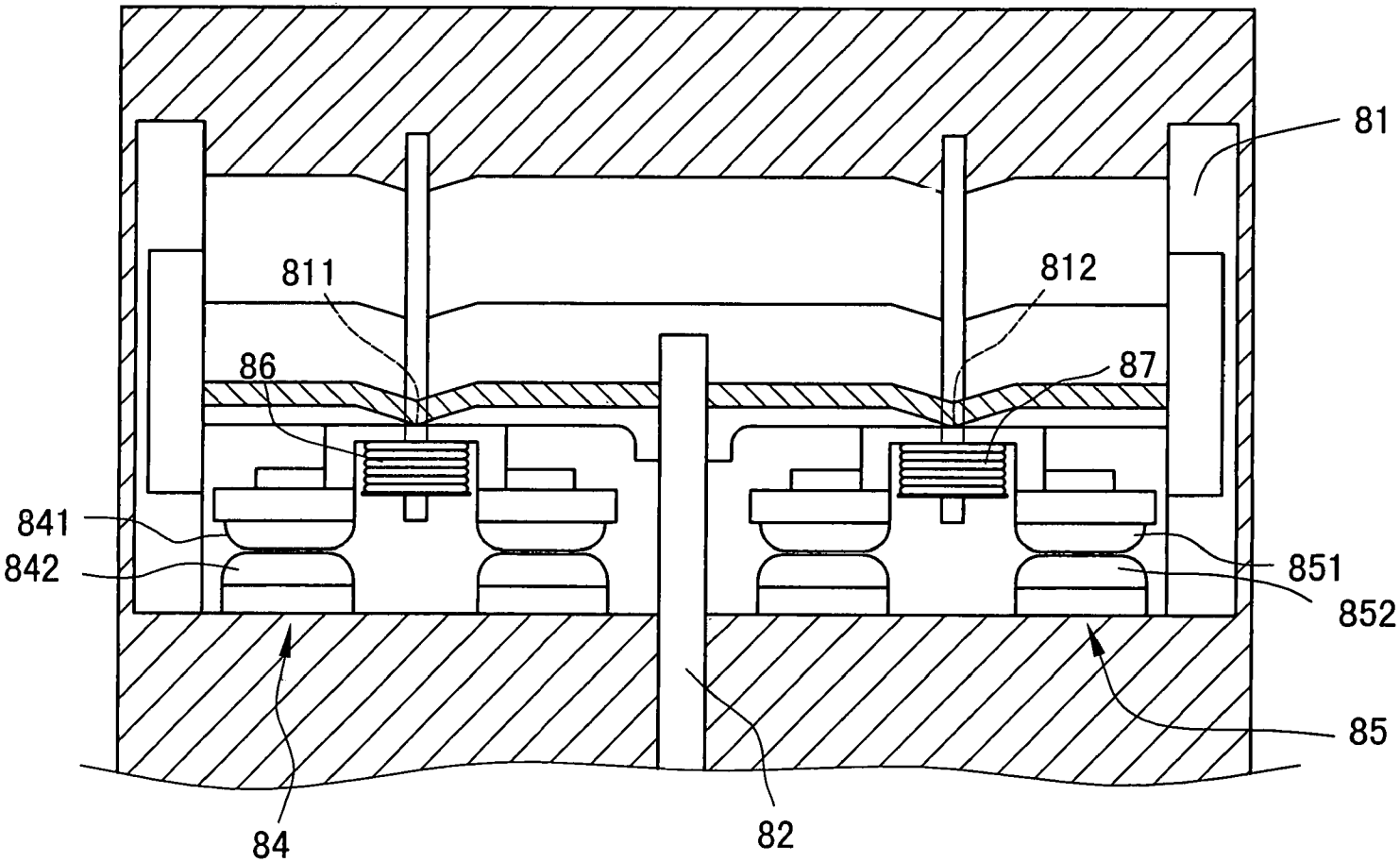
FIG. 2 shows that the first and second contact units are in contact with each other.
Figure 3:
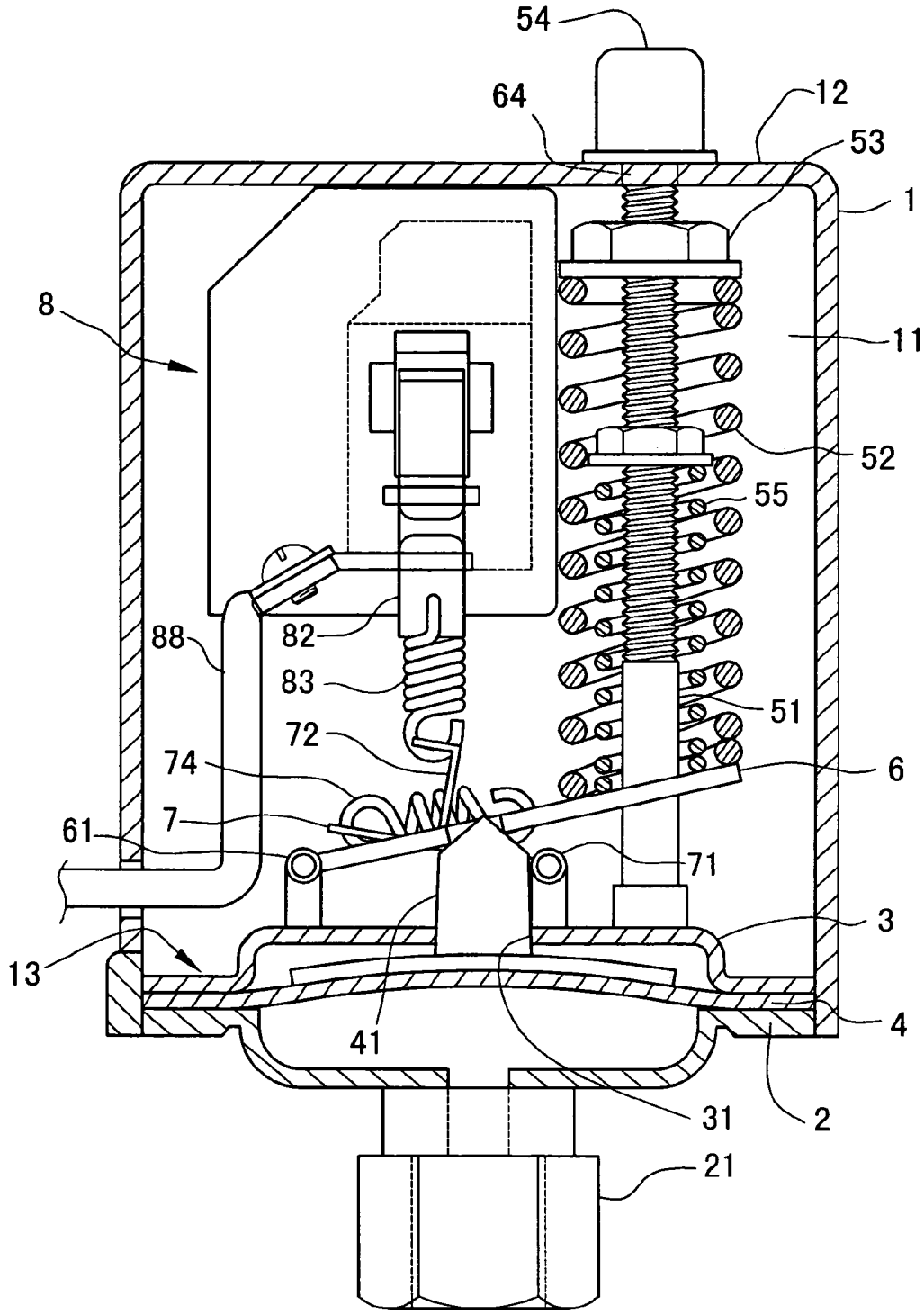
FIG. 3 shows that the first and second plates are pulled upward.
Figure 4:
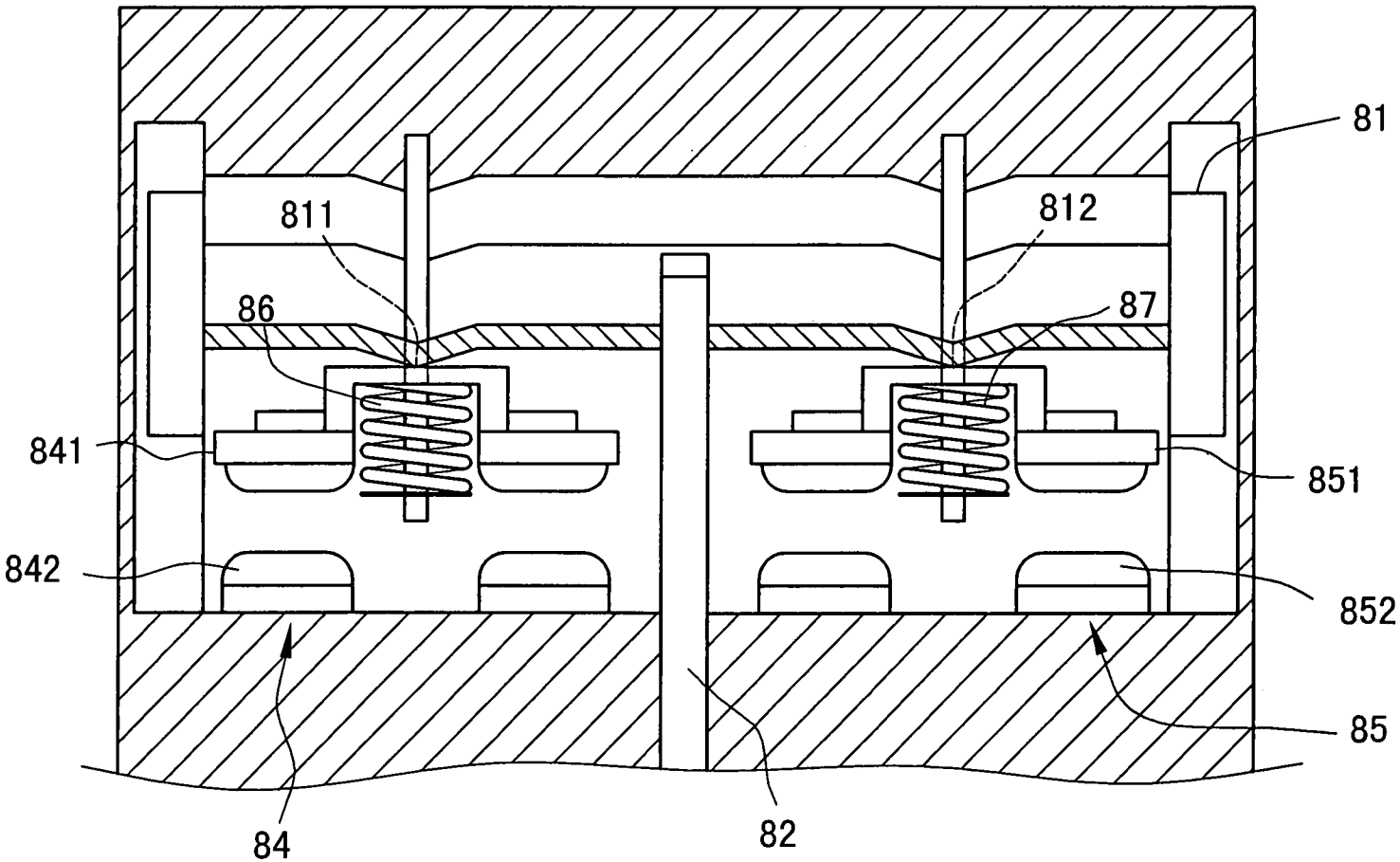
FIG. 4 shows that the first and second contact units are separated from each other.
Figure 5:
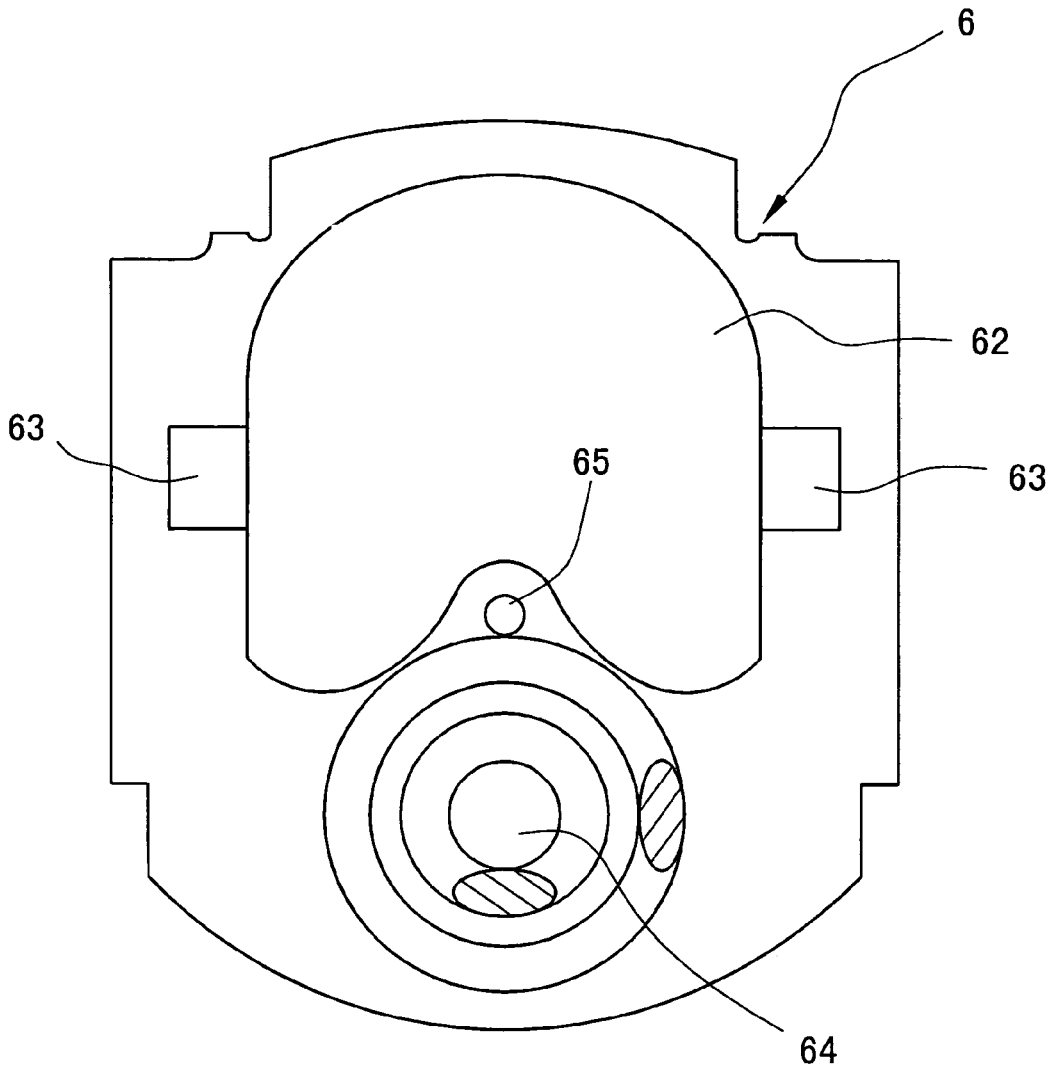
FIG. 5 shows the first plate of the present invention.
Figure 6:
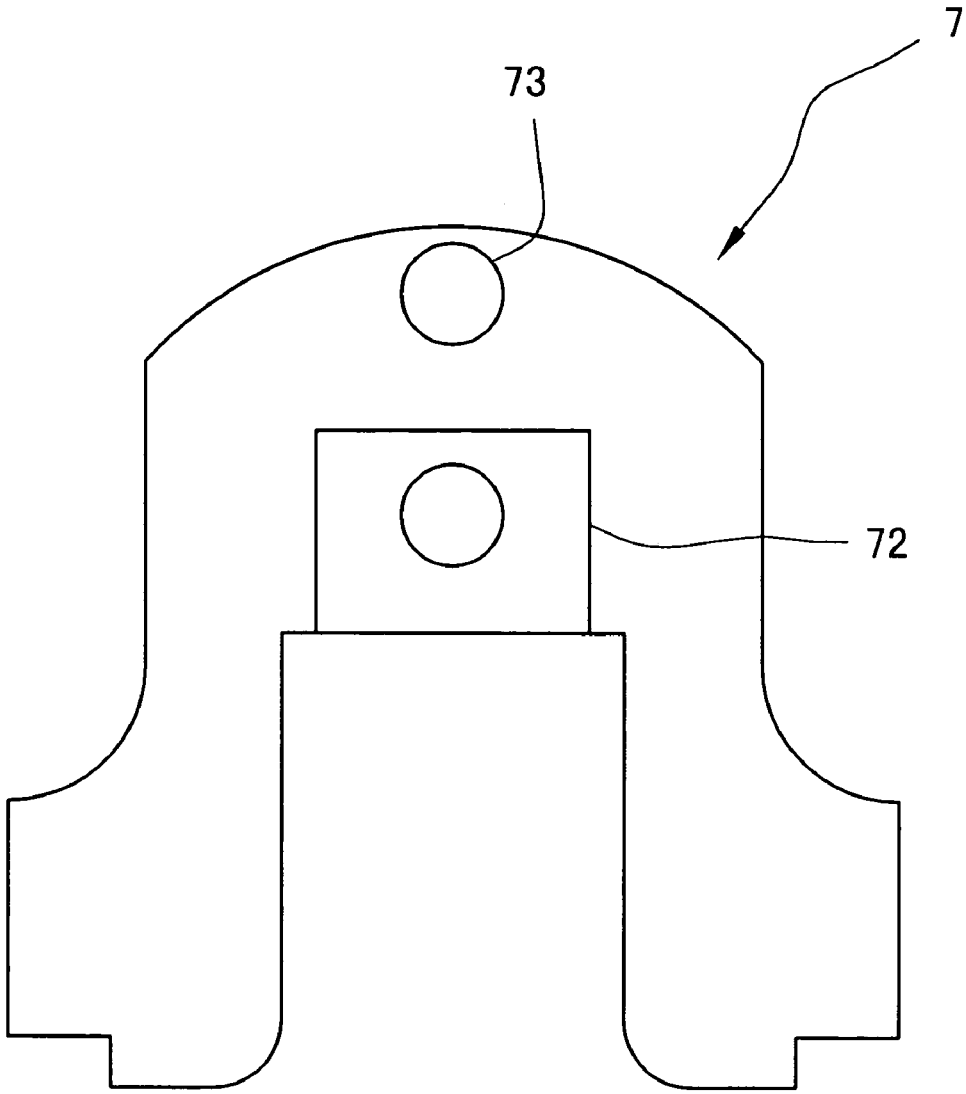
FIG. 6 shows the second plate of the present invention.

Referring to FIGS. 1 to 6, the pressure switch of the present invention comprises a cylindrical box 1 which has a space 11 defined therein and includes a close end 12 and an open end 13. An outer cover 2 is connected to the open end 13 of the box 1 and an inlet 21 is defined through the outer cover 2 so as to introduce water into the box 1. An inner cover 3 is engaged with the open end 13 and has a central hole 31. A film 4 is located between the outer cover 2 and the inner cover 3, and has a push portion 41 which extends through the central hole 31 of the inner cover 3.

An initializing device 5 located in the box 1 and has a rod 51 and a first spring 52 mounted to the rod 51. An adjustment member 53 is threadedly connected to the rod 51 and located above the first spring 52. The rod 51 has one end extending through a hole 64 in the close end 12 of the box 1 and is connected to a nut 54. The other end of the rod 51 is connected to the inner cover 3.

A first plate 6 has a pivot end 61 pivotably connected to the inner cover 3 and a through hole 62 is defined through the first plate 6. The first plate 6 is located between the first spring 52 and the push portion 41. A mounting hole 64 is defined through the first plate 6 and the rod 51 extends through the mounting hole 64. The first plate 6 includes two openings 63 so that a tip of the push portion 41 may extend therethrough. A second plate 7 extends through the through hole 62 of the first plate 6 and has a pivotal end 71 which is located opposite to the pivot end 61 of the first plate 6 and connected to the inner cover 3.

An activation device 8 is located above the first and second plates 6, 7 and including a frame 81 and a pull rod 82 which is connected to a center of the frame 81. A second spring member 83 is connected between a lug 72 located at a center of the second plate 7 and the pull rod 82. A first contact unit 84 and a second contact unit 85 are located on two sides of the pull rod 82 and connected to the frame 81. The frame 81 includes two tip portions 811, 812 with the pull rod 82 located therebetween, the two tip portions 811, 812 respectively contact the first contact unit 84 and the second contact unit 85.

In order to reinforce the spring force that is applied to the first plate 6, a third spring 55 is mounted to the rod 51 and located at inner periphery of the first spring 52. Each of the first and second plates 6, 7 has a hook hole 65/73 so that a fourth spring 74 is hooked the two respective hook holes 65, 73 in the first and second plates 6, 7.

The first contact unit 84 has a first upper contact portion 841 and a first lower contact portion 842, a fifth spring 86 is connected to the first upper contact portion 841. The second contact unit 85 includes a second upper contact portion 851 and a second lower contact portion 852, a sixth spring 87 is connected to the second upper contact portion 851.

When the water pressure is lowered, the pull rod 83 is pulled downward by the third spring 55 so that the first and second upper contact portions 841, 851 are in contact with the first and second lower contact portions 842, 852. The electrical wires 88 of the first and second contact units 84, 85 are powered so as to activate the pump which is not shown.

When the water pressure is larger than the force of the first spring 52, the push portion 41 of the film 4 is pushed inward to push the first plate 6 and pivots the second plate 7 upward. The pull rod 82 connected to the lug 72 on the second plate 7 an the second plate 7 both push the frame 81 so that the first and second upper contact portions 841, 851 are separated from the first and second lower contact portions 842, 852. The fifth and sixth springs 86, 87 bounce back to ensure all the contact portions are separated to stop the pump.

The two tip portions 811, 812 are in contact with the two respective centers of the first contact unit 84 and the second contact unit 85 so that the first and second contact units 84 and 85 apply an even force which prevents the pressure switch from shaking. The direction of the water flow from the inlet 21 and the direction of the movement of the fist and second contact units 84, 85 are the same, so that only a smaller space is needed and the inlet 21 is located at a center of the box 1 which is convenience for installation.

Figure 7:
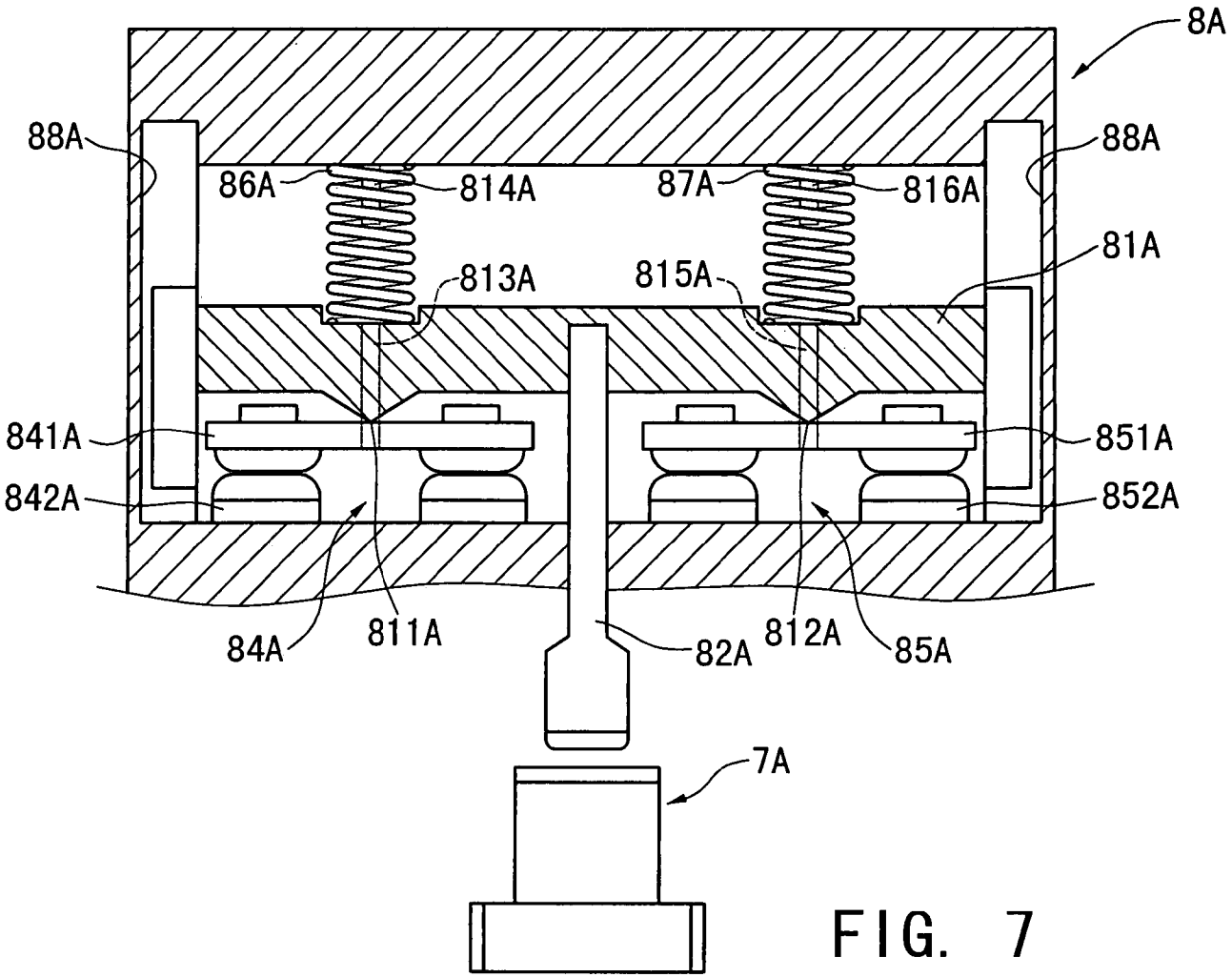
FIGS. 7 and 8 show two operation status of a second embodiment of the pressure switch of the present invention.
Figure 8:
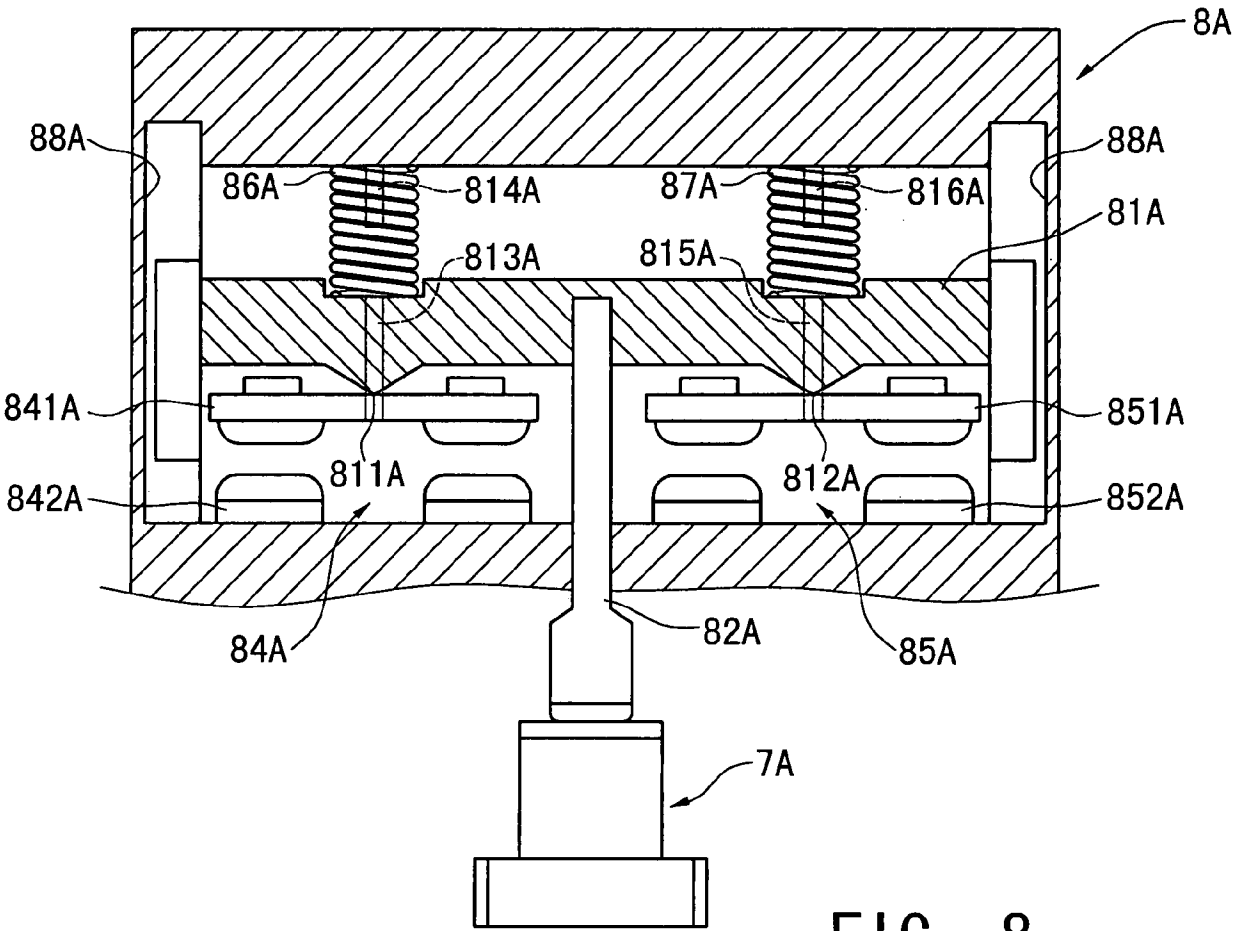
Figure 9:
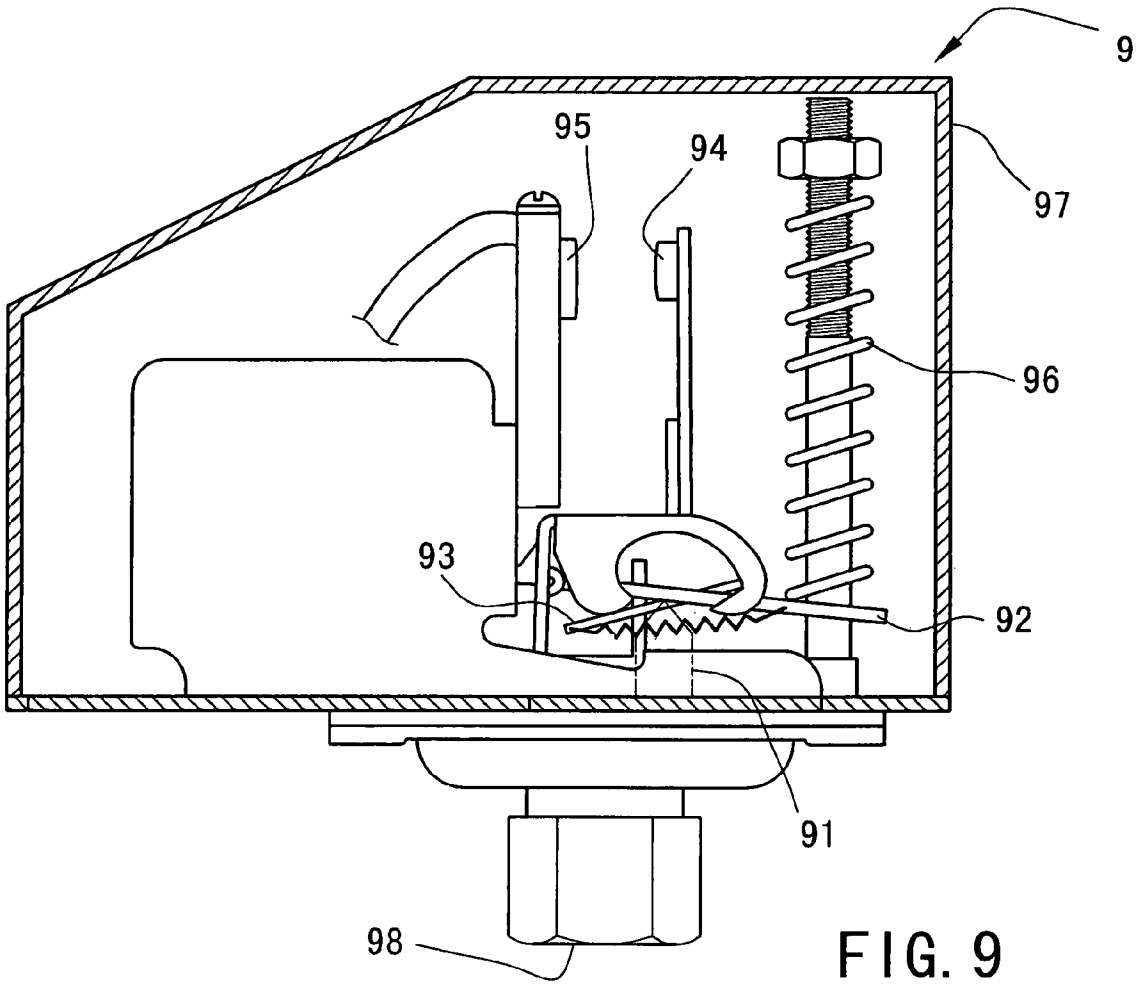
FIG. 9 PRIOR ART
FIG. 9 shows a conventional pressure switch.

Referring to FIGS. 7 and 8 which show a second embodiment of the present invention wherein the activation device 8A is located between the space 11A and the second plate 7A, and includes a push rod 82A which has one end connected to a frame 81A guided by rails 88A. The other end of the push rod 82A is in contact with the lug 72A of the second plate 7A. The frame 81A is connected to a first contact unit 84A and a second contact unit 85A located on the two sides of the push rod 82A. The first contact unit 84A includes a first upper contact portion 841A and a first lower contact portion 842A, the second contact unit 85A includes a second upper contact portion 851A and a second lower contact portion 852A. The first and second contact units 84A, 85A are moved with the push rod 82A so that the first upper and lower contact portions 841A, 842A and the second upper and lower contact portions 851A, 852A can be in contact with each other or separated from each other.

The frame 81A includes two tip portions 811A, 812A which are located on the two sides of the push rod 82A. The two tip portions 811A, 812A are respectively in contact with the first contact unit 84A and the second contact unit 85A. The first contact unit 84A includes a first upper contact portion 841A and a first lower contact portion 842A, the second contact unit 85A includes a second upper contact portion 851A and a second lower contact portion 852A. The tip portions 811A includes a first guide rod 813A which is connected to the frame 81A and is in contact with the first upper contact portion 841A.

A first cam 814A is located on a side of the frame 81A and opposite to the first upper contact portion 841A. The first cam 814A is located corresponding to the first guide rod 813A. The other tip portions 812A includes a second guide rod 815A which is connected to the frame 81A and is in contact with the second upper contact portion 851A. A second cam 816A is located on the side of the frame 81A and opposite to the second upper contact portion 851A. The second cam 816A is located corresponding to the second guide rod 815A. A fifth spring 86A is mounted on the first cam 814A and a sixth spring 87A is mounted on the second cam 816A. In this embodiment, the fifth spring 86A and the sixth spring 87A are springs and located opposite to the first and second contact units 85A, 86A.

When the second plate 7A moves downward, the push rod 82A of the activation device 8 moves downward to drive the first upper contact portion 841A of the frame 81A to be in contact with the first lower contact portion 842A. The second upper contact portion 851A is in contact with the second lower contact portion 852A. By the spring forces of the fifth spring 86A and the sixth spring 87A, the first upper contact portion 841A of the first contact unit 84A is in contact with the first lower contact portion 842A, and the second upper contact portion 851A of the second contact unit 86A is in contact with the second lower contact portion 852A. By this way, the circuit is connected between the first and second contact units 84A, 85A so that the pump is activated.

While we have shown and described the embodiment in accordance with the present invention, it should be clear to those skilled in the art that further embodiments may be made without departing from the scope of the present invention.

What is claimed is:

1. A pressure switch comprising:

a box having a space therein and including a close end and an open end;

an outer cover connected to the open end of the box and an inlet defined through the outer cover;

an inner cover engaged with the open end and having a central hole;

a film located between the outer cover and the inner cover, a push portion extending from the film and extending through the central hole of the inner cover;

an initializing device located in the space of the box and having a rod and a first spring mounted to the rod, the rod having one end extending through the close end of the box and the other end of the rod connected with the inner cover;

a first plate received in the box and having a pivot end pivotably connected to the inner cover, a mounting hole defined through the other end opposite to the pivot end of the first plate and the rod extending through the mounting hole, the first spring contacting the rod, a through hole defined through the first plate;

a second plate extending through the through hole of the first plate and having a lug, the second plate connected to the inner cover, the second plate connected to the first plate by a fourth spring, and an activation device located between the space of the box and the second plate, the activation device including a pull rod which has one end connected to a frame guided by rails, the other end of the pull rod connected to the lug of the second plate, the frame connected to a first contact unit and a second contact unit located on the two sides of the pull rod, the first contact unit including a first upper contact portion and a first lower contact portion, the second contact unit including a second upper contact portion and a second lower contact portion, the first and second contact units moved with the pull rod so that the first upper and lower contact portions and the second upper and lower contact portions are in contact with each other or separated from each other.

2. The switch as claimed in claim 1, wherein the push portion of the film extends through the central hole in the inner cover.

3. The switch as claimed in claim 1, wherein the initializing device includes an adjustment member located on the rod and above the first spring.

4. The switch as claimed in claim 1, wherein the first plate includes at least one opening so that a tip of the push portion extends therethrough.

5. The switch as claimed in claim 1, wherein a third spring is mounted to the rod and located at inner periphery of the first spring.

6. The switch as claimed in claim 1, wherein each of the first and second plates has a hook hole so that a fourth spring is hooked the two respective hook holes in the first and second plates.

7. The switch as claimed in claim 1, wherein the frame includes two tip portions which are located on the two sides of the push rod, the two tip portions respectively contact the first contact unit and the second contact unit.

8. The switch as claimed in claim 7, wherein one of the tip portions includes a first guide rod which extends though the frame and is in contact with the first upper contact portion, the other tip portion includes a second guide rod which extends though the frame and is in contact with the second upper contact portion, a fifth spring is mounted on the first guide rod and a sixth spring is mounted on the second guide rod.

9. The switch as claimed in claim 8, wherein the fifth spring is located between the first contact unit and the frame, the sixth spring is located between the second contact unit and the frame.

10. The switch as claimed in claim 7, wherein one of the tip portions includes a first guide rod which is connected to the frame and is in contact with the first upper contact portion, a first cam is located on a side of the frame and opposite to the first upper contact portion, the first cam is located corresponding to the first guide rod, the other tip portions includes a second guide rod which is connected to the frame and is in contact with the second upper contact portion, a second cam is located on the side of the frame and opposite to the second upper contact portion, the second cam is located corresponding to the second guide rod, a fifth spring is mounted on the first cam and a sixth spring is mounted on the second cam.

* * * * *